US011124019B1

(12) United States Patent
Curtis

(10) Patent No.: US 11,124,019 B1
(45) Date of Patent: Sep. 21, 2021

(54) ELECTRICALLY POWERED STRIPPING TOOL

(71) Applicant: Donald Curtis, Vallejo, CA (US)

(72) Inventor: Donald Curtis, Vallejo, CA (US)

( * ) Notice: Subject to any disclaimer, the term of this patent is extended or adjusted under 35 U.S.C. 154(b) by 0 days.

(21) Appl. No.: 17/334,506

(22) Filed: May 28, 2021

(51) Int. Cl.
*A47L 13/08* (2006.01)
*B44D 3/16* (2006.01)

(52) U.S. Cl.
CPC ..... *B44D 3/168* (2013.01); *B44D 3/164* (2013.01)

(58) Field of Classification Search
CPC ..... B44D 3/168; B44D 3/164; A47L 13/03; A47L 13/08; A47L 3/022; B46B 15/081
See application file for complete search history.

(56) References Cited

U.S. PATENT DOCUMENTS

| | | | | |
|---|---|---|---|---|
| 2,308,047 | A | 1/1943 | Blakeslee | |
| 2,315,121 | A | 3/1943 | King | |
| 2,497,535 | A | 2/1950 | Carlino | |
| 2,588,185 | A | 3/1952 | Walter | |
| 2,680,188 | A | 6/1954 | Stephens | |
| 2,778,919 | A | 1/1957 | Vicario | |
| 2,797,294 | A | 6/1957 | Cox | |
| 2,918,685 | A | 12/1959 | Sundstrom | |
| 3,673,383 | A * | 6/1972 | Sofia | B23D 79/06 219/227 |
| 4,065,214 | A * | 12/1977 | Daum | A47L 13/32 401/2 |
| 4,849,607 | A | 7/1989 | Meo | |
| 5,208,895 | A | 5/1993 | Hoover, Jr. et al. | |
| 5,313,931 | A * | 5/1994 | Coulcher, Jr. | B44D 3/166 126/271.1 |
| 5,575,035 | A * | 11/1996 | Reis | A47L 13/02 15/324 |
| 5,973,294 | A * | 10/1999 | Schatt | A47L 1/16 219/228 |
| 6,822,197 | B1 | 11/2004 | Mattfield | |
| 7,964,822 | B2 * | 6/2011 | Suen | B44D 3/166 219/228 |
| 2009/0188066 | A1 * | 7/2009 | Van Deursen | B44D 3/164 15/236.01 |
| 2019/0029480 | A1 * | 1/2019 | Niehaus | A47L 1/06 |

* cited by examiner

*Primary Examiner* — Dung Van Nguyen
(74) *Attorney, Agent, or Firm* — Iron Gate Intellectual Property; Andres Salazar

(57) ABSTRACT

A finish removal tool for removal of a variety of finishes is provided having a rigid two-handled body, a scraper blade and ducted forced convection heating and cooling elements configured for continuous operation. Embodiments may include adjustable power levels, temperature sensor, indicator lighting, exhaust ducting and heat shields. A variety of scraper blade accommodations are described.

16 Claims, 4 Drawing Sheets

ELECTRICALLY POWERED STRIPPING TOOL

TECHNICAL FIELD OF THE INVENTION

The disclosure relates to wood surface finish removal enhanced with controlled heat, including cooling elements for continuous operation.

BACKGROUND OF THE INVENTION

There are several categories of wood finishes used on furniture, flooring, boats, and other wood structures. Finishing products can be grouped into manageable categories, based on general working qualities and the degrees of protection they offer: waxes, oils, varnishes, shellacs, lacquers and water-based finishes. Different finishes offer varying degrees of protection, durability, ease of application, repairability and aesthetics. Unfortunately, no single finish excels in all of these categories. A finish that excels in one may fail in another.

Each of the finish categories typically have an environmental range within which they deliver the desired performance that is expected of them. If the characteristics of the environment exceed the finish's specified parameters, the finish is prone to fail in one or more aspects of its performance. Beyond choice of finish, achieving the desired finish performance is dependent upon observance to commonly specified requirements of substrate preparation, finish application and curing parameters that must be adhered to. Finally, the performance of the finish can only be provided as long as the wood surface is maintained within specified environmental conditions.

The wood structures themselves differ in both types of wood and thickness of the surface to which the finish is applied. Furthermore, in preparing the wood surface prior to applying a finish, one has to be careful of the direction and slope of the grain, especially for thin or veneered wood surfaces as they can be easily gouged beyond repair. With proper preparation and careful selection and application of a finish, one can optimize the appearance and performance of the wood structure.

Regardless of the quality of the surface preparation and finish application, usage, environmental factors and time may contribute to performance and aesthetic degradation of the finish, leading to the need to refinish the wood surface to extend the life of the structure. A proper refinish requires the same diligence in surface preparation as performed on the virgin surface, except for the additional step of removing the existing finish.

Removal of an existing finish from a wood surface may be done in a single or a combination of ways, either mechanically by scraping or sanding, or chemically through the use of solvents or strippers, after which, a final surface preparation is performed, typically sanding with progressively finer grit sand paper. In a broad sense, these removal methods all constitute exceeding the operating parameters of the applied finish in order to break down and remove the finish.

Removal of the surface finish by sanding is labor intensive and results in airborne particulate of the finish. This may lead to hazardous exposure and requires extensive air filtering to capture and dispose of the particulate. While less labor intensive, chemicals and solvents produce additional hazardous waste, and therefore may not be preferred as the main method, especially on large largely flat surfaces where large amounts of these chemicals might be required.

Scrapers, either push or drag type, minimize airborne release of the removed finish and are commonly used for finish removal. When using a push-type blade, one is attempting to use the blade edge to wedge between the wood surface and the finish in order to separate the finish layer from the wood substrate. If the finish is strongly bonded to the wood surface, it can be difficult to forcibly separate the layers and can lead to damage of the wood surface. This approach runs the risk of gouging of the wood surface, especially where the grain pattern runs down into the wood along the path of the blade.

A drag blade acts to progressively scrape away portions of the finish layer. By itself, this takes multiple scrapping strokes, but is less prone to gouging the wood surface. By themselves, drag scrapping and certainly sanding tend to release more dust.

Further complicating the finish removal process, deeply penetrating stains and finishes may have been applied. In this case, extracting the applied finishes that are in-grained into the depth of the wood structure requires that their bonds to the wood be released, such as with solvents, prior to mechanically extracting the finishes.

An alternative, yet common, method for enhancing surface finish removal is to first heat the finish to a temperature beyond the specified operating tolerance so that the finish fails in its adherence to the wood surface and it releases from the wood surface. Once the finish reaches this temperature and releases, one can more easily scrape off the finish with a drag blade without releasing any dust. Heating the finish can also be effective for removing in-grained stains and finishes.

It is important that the finish not be heated significantly past its release temperature to beyond its melting point. Doing so will causes two problems. First, elevating the finish to its melting point causes it to become a sticky "goo", which then builds up on the blade, necessitating constant cleaning or wiping off of the excess melted finish from the blade. Not only does this slow down the process, but it also causes excess heat build-up in the blade, which then transfers back to the finish, worsening the process.

Secondly, excessive heat application accelerates vaporization of any volatile organic compounds (VOCs) contained in the finish, possibly leading to dangerous exposures. Moreover, elevated temperatures can cause the removed finish to reach its flash point and start burning.

Example release temperatures for latex-, oil-based- and epoxy-type finishes used the in the boating industry are approximately 200 degrees, 320 degrees and 350 degrees, respectively. The respective melting points are approximately 250 degrees, 350 degrees and 400 degrees. In this case, there exists a small 30-degree to 50-degree temperature working window for efficient removal of the finishes. While various finish compositions used in diverse industries will have different release, melting and flash-point temperatures, what is important is to recognize the distinctions between these temperatures, and exploit them to achieve optimal removal enhancement.

Thus, traditional approaches using uncontrolled heat application as a finish release enhancement to a scraping approach, without regard to the state the finish, are slow, cannot be performed continuously and require a much higher skill level on the part of the operator. Contrarily, when accurately heated to its release temperature, a drag-scrapped finish lifts off as flakes, which are more easily diverted away from the work surface and the blade, facilitating better control of the heat and waste, making an efficient, continuous operation possible.

Also of importance is protection of the wood substrate during this process. It is the heating of the finish to a release temperature that breaks the bonding to the wood surface, not the heating of the wood substrate. In fact, if the blade is allowed to heat up under continuous use, it can scorch the wood, damaging the surface and leaving unsightly burn marks that have to be sanded out. When this occurs in a veneered wood surface, it runs the risk of ruining the surface, either through burning through it, or having to sand through it to remove the burned areas.

Finally, it is inevitable that finish removal from a wood surface leads to some degree of damage of the wood surface as the bonded, usually penetrated, finish is mechanically scrapped and pulled away from the wood. It is therefore desired to minimize this damage in order to minimize the required surface preparation prior to refinishing the wood surface, especially important when the wood surface is a veneer of limited thickness.

When effectively performed, proper finish removal mitigates exposure to hazards, limits hazardous waste, extends the life of the wood structure and allows for the recovery of the work of the previous finisher, saving the labor necessary to prepare the wood surface to accept the new finish.

SUMMARY OF THE INVENTION

The instant invention discloses and teaches an apparatus and method that provides for efficient removal of wood finish in a continuous operation that doesn't require a highly skilled operator. The instant invention integrates controlled heat application elements as a finish release enhancement to a drag scraper having two handles for smooth and consistent operation. The apparatus further incorporates air flow ducting for clearing of removed finish and heat removal from scraping elements, thus facilitating continuous operation. Alternate embodiments include temperature sensors and indicator lighting for more precise operation, variably controlled heat and air flow via selectable setting elements allowing for diverse finish-type removal, and heat shielding for operator safety and comfort.

It is therefore an objective of the instant invention to provide an apparatus that removes finish from a wood surface, leaving it smooth and clean enough to refinish with little or no sanding.

It is also an objective of the instant invention to provide an apparatus that minimizes heat build-up and allows for continuous use without having to stop for removal of finish material build-up.

It is also an objective of the invention to provide an apparatus that doesn't require a high degree of skill level to remove finish.

It is also an objective of the instant invention to provide an apparatus that allows for managed capture of the removed finish.

It is also an objective of the instant invention to provide an apparatus that causes little to no airborne particulate release.

It is also an objective of the instant invention to provide an apparatus that minimizes finish vaporization release.

DETAILED DESCRIPTION OF THE INVENTION

Figure 1:
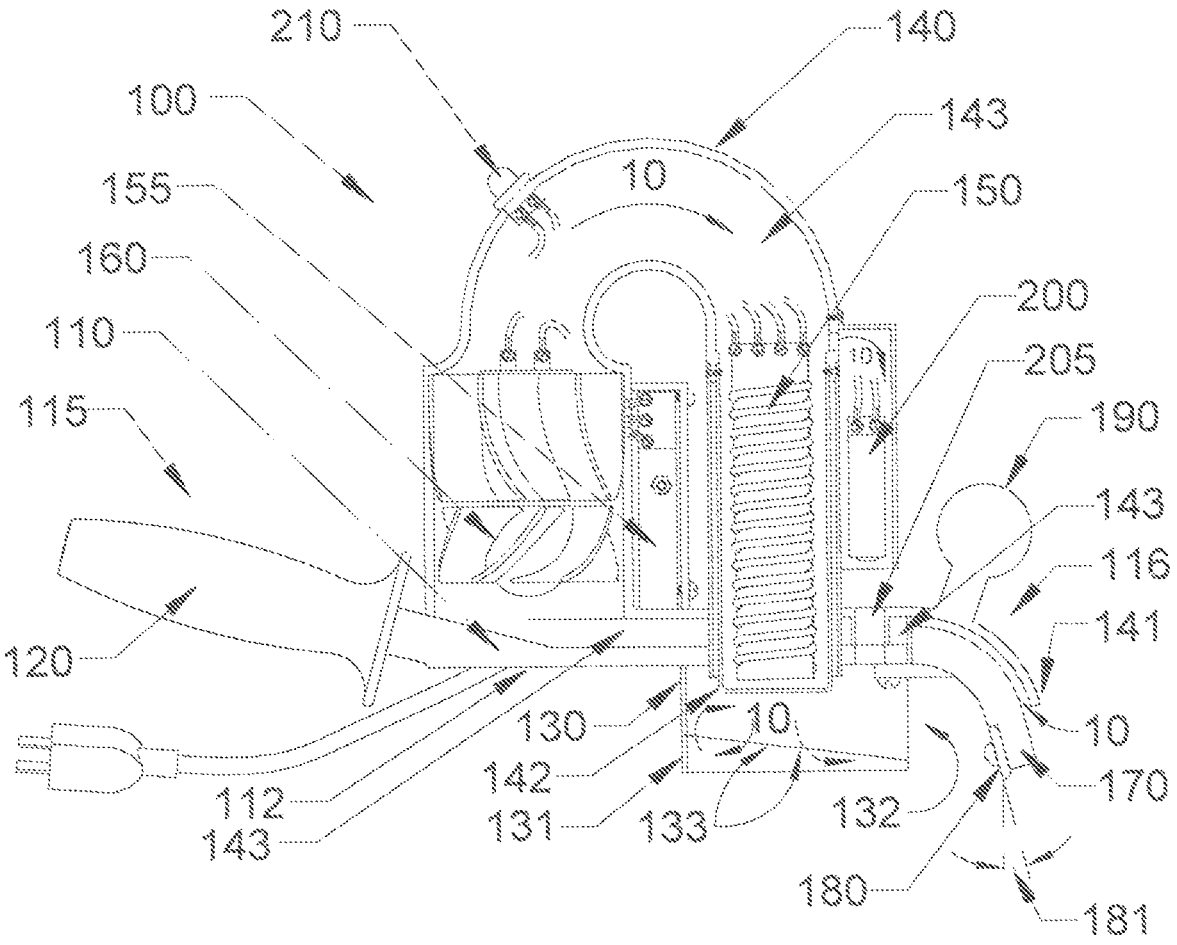
FIG. 1 exemplifies an embodiment of the electrically powered stripping tool.
Figure 8:
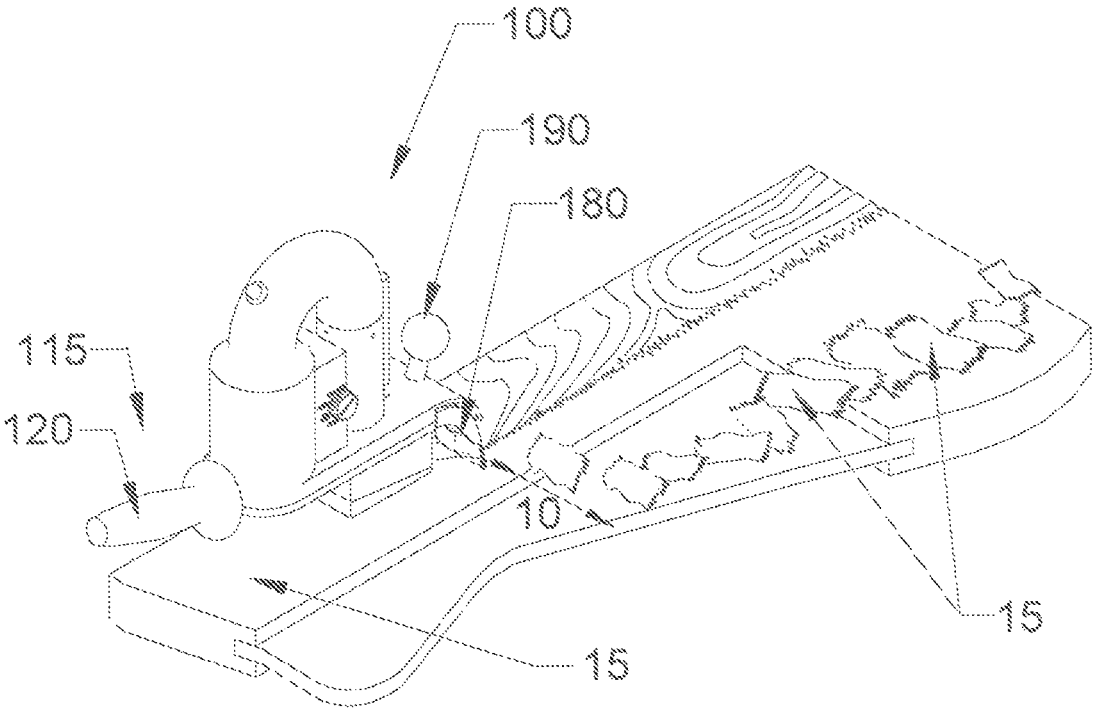
FIG. 8 exemplifies use of the electrically powered stripping tool on a finish.

FIG. 1 illustrates an example embodiment of the electrically powered stripping tool (100), while FIG. 8 illustrates use of the electrically powered stripping tool (100) on a wood substrate, as will be described. The tool body (110) extends in a longitudinal shape with a tool end (116) and an opposing handle end (115) and a work surface side (112) being the side that faces, typically down or horizontal, the wood surface being worked on. The tool has two handles, one on each end for a controlled force and stoke operation of the device. In one embodiment, the handle (120) on the handle end (115) of the tool body (110) might be an elongated first-type handle and the second handle (190) on the tool end (116) of the tool body (110) might be of a knob design. Other, more specific designs for these handles will accommodate comfort of the operator.

Figure 4:
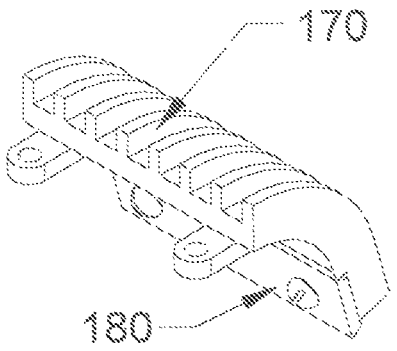
FIG. 4 illustrates an embodiment of the electrically powered stripping tool scraper blade and heat sink.

A scraper blade (180), removably attached to, and in thermal communication with, a heat sink (170), extends outwards from the tool body (110) on the tool end (116) of the tool body (110) out from the work surface side (112) at a trailing angle (181) to the work surface, typical of a scraper blade. The heat sink (170) is rigidly attached to the tool body (110) so that the scraper blade (180) has a rigid connection to the tool body (110). The width of the scraper blade (180) is not limited to any dimension, but will vary based upon industry practices in any given application of the tool (100). FIG. 4 exemplifies an embodiment of the scraper blade (180) to heat sink (170) relationship.

As shown in FIG. 8, finish (15) on a wood substrate is removed by stroking the tool (100) in the direction of the handle end (115) as moderate pressure is applied on both the handle (120) and second handle (190) to engage the scraper blade (180) with the finish (15).

Referring to FIG. 1, to enhance removal of the finish (15) from the wood substrate, heat is applied by forced convection via air (10) travelling through an air flow duct (140) and directed onto the finish (15) to be removed. The air flow duct (140) comprises an inlet end (141) and an outlet end (142), with an internal cavity (143) extending between the inlet end (141) and the outlet end (142). The outlet end (142) of the air flow duct (140) is attached nominally vertically through the tool body (110) where it directs the air (10) directly onto the finish (15) to be removed. This allows a portion of the air (10) to pass along the profile of the scraper blade (180) to disperse removed finish (15) that comes off in manageable flakes, rather than fine, air-borne particulate, as in sanding.

Comprised within the internal cavity (143) of the air flow duct (140) is an electrical heating element (150) that heats the air (10) as it travels through the air flow duct (140). Air (10) is moved through the airflow duct (140) from the inlet end (141) to the outlet end (142) by an electrical fan (160)

located in the internal cavity (143) of the air flow duct (140) between the inlet end (141) and the electrical heating element (150).

In the preferred embodiment, a hot air guide (130) is attached to the tool body (110) on the work surface side (112) adjacent to the outwardly extending scraper blade (180) where it receives the hot air (10) from the air flow duct (140) and more precisely directs the air (10) onto the finish (15) to be removed and onto the scraper blade (180) profile for effective finish (15) flake dispersal.

The hot air guide (130) comprises a nominally rectangular design. The nominal rectangular design is comprised of two opposing lateral sides (133), a front side (131), and an opposing open side (132) which is adjacent to the scraper blade (180). The two lateral sides (133) define the width of the rectangular design, nominally equal to the width of the scraper blade (180). As the air (10) enters the hot air guide (130), it is directed nominally vertically directly at the work surface where, by forced convection, it effectively confines the air (10) to heat the finish (15) to its release temperature just ahead of the advancing scraper blade (180). It should be understood that the outlet end (142) of the air flow duct (140) may be shaped to accommodate the structure of the hot air guide (130) in lieu of a separate hot air guide (130) element.

While the front side (131) and lateral sides (133) of the hot air guide (130) confine the heated air (10) on three sides to enhance convective heating of the finish (15) ahead of the advancing scraper blade (180), a large portion of the forced air (10) then exits the hot air guide (130) against the scraper blade (180) and out laterally from the tool (100), conveying the released finish (15) flakes with the air (10), thus maintaining a clean scraper blade (180).

During operation, the scraper blade (180) is continuously in contact with both the heated exiting air (10) and the heated finish (15), and in the process, both contribute to some heating of the scraper blade (180). To mitigate this, in the instant invention, the inlet end (141) of the air flow duct (140) is located near the heat sink (170) such that the inlet end (141) of the air flow duct (140) accepts a portion of the heat sink (170) into the internal cavity (143) of the air flow duct (140). As the electrical fan (160) draws air (10) into the air flow duct (140) over the heat sink (170), the drawn in unheated air (10) removes heat from the heat sink (170) by forced convection, allowing the heat sink (170) to conduct the excess heat away from the scraper blade (180), keeping the blade temperature below the melting temperature of the finish (15) so that the scraper blade (180) does not contribute to additional heating of the finish (15) and cause build-up. This cooling aspect of the instant invention facilitates continuous use of the tool (100).

The scraper blade (180) can be made of most alloys of stainless steel, carbide steel or most any metal used for scraper blades. In the best mode, the blade is comprised of a metal with a moderate to good heat transfer performance. Acceptable blades, such as carbon steel, have a thermal conductivity of approximately 45-50 W/m-K. Superior to this are aluminum-bronze alloy scraper blades, which have a thermal conductivity approaching 200 W/m-K. The heat sink (170) should be made of any rigid metal or metal alloy material with good thermal conductivity, including but not limited to materials such as copper, aluminum, copper brass, or alloys, such as aluminum bronze. Thermal conductivity for the heat sink (170) should exceed that of the chosen scraper blade (180).

Thermal grease or intermediate thermal interface materials may be used between the scraper blade (180) and the heat sink (170), if necessary, to enhance heat transfer away from the scraper blade (180) across the scraper blade (180) to heat sink (170) interface.

For a given finish (15) type and thickness, elevating the finish (15) temperature to the desired range is a function of heat applied and length of time applied. In the refinishing industries, removal of finish (15) by scraping is performed in a surprisingly consistent stroke speed when done by hand, thus fixing the length of time. In the case of the instant invention, the applied heat variable can then be further simplified down to two variables: temperature and flow volume of the air (10) directed at the finish (15). A minimum volume of air (10) flow is required in the instant invention in order to clear the removed finish (15) from the scraper blade (180) as well as to convect heat away from the heat sink (170). In the best mode, for a hand-held scale embodiment of the instant invention, air (10) flow of approximately 20 cubie feet per minute (CFM) accomplishes both of these objectives. This is easily achieved with commonly available electrical fan (160) elements powered by a 110-volt 15-amp household circuit. The inventive concept easily applies to larger capacity embodiments as well, and can be implemented using increased amperage or voltage circuits that would be available in a refinishing work setting to deliver increased air (10) flow.

The remaining variable, the required temperature of the air (10) depends upon the release temperature of the finish (15) to be removed. Lower release temperature finishes, such as latex-based finishes, clearly demand lower air (10) temperatures than finishes with higher release temperatures, such as oil-based finishes, in order to bring them up to the release temperature by forced convection. Finishes with still higher release temperatures, such as epoxy-based finishes, require even higher air (10) temperatures in order to bring them up to the release temperature by forced convection. Again, for hand-held scale embodiments of the instant invention, this is easily achieved with commonly available electrical heating elements (150) powered by a 110-volt household circuit. Larger capacity embodiments can be implemented using increased amperage or voltage circuits that would be available in a refinishing work setting to deliver increased temperatures.

In the preferred embodiment, a single tool (100) can be used for removal of any of several types of finishes by use of a selector switch to control the temperature of the air (10). Referencing FIG. 2, the instant invention is configured to simplify adjustment of the temperature of the air (10) with a temperature or finish material selector switch (165). This selector switch (165) would work in combination a variable wattage electrical heating element, electrically pulsed heating elements or multiple heating elements, any of which are represented as the electrical heating element (150) on FIG. 1. Given the relatively standard release temperatures of latex-, oil- and epoxy-based finishes, and the relatively standard scrape, or stroke, speeds used in the refinishing industry, the finish material selector switch (165) setting is pre-calibrated to power the electrical heating element (150) wattage that is optimized for removal of a selected type of finish (15).

Either hard wiring from the finish material selector switch (165) to the electrical heating element or wiring through a simple control module (155), see FIG. 1, can be used. In this context, the control module could be as simple as a terminal strip for power distribution to and from the material selector switch (165), electrical fan (160), electrical heating element (150), and any external power circuitry. It is also contemplated, as will be described, that the control module (155)

may incorporate temperature, motion, particulate or other sensory input and additional display elements in order to achieve additional control functionality, an in addition, the control module (155) may be embodied using a programmable device as well.

Figure 2:
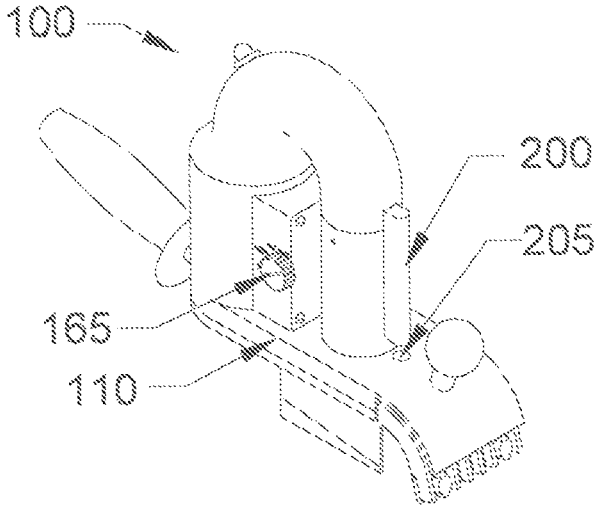
FIG. 2 exemplifies a perspective view of an embodiment of the electrically powered stripping tool with auxiliary features.
Figure 3:
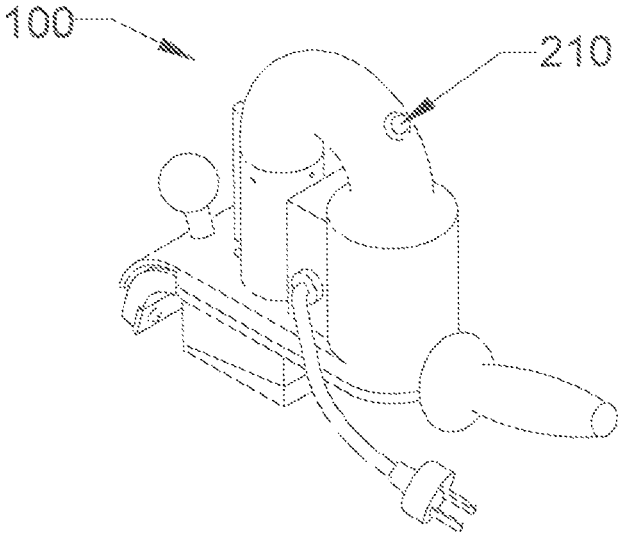
FIG. 3 exemplifies an additional perspective view of an embodiment of the electrically powered stripping tool with auxiliary features.

As illustrated in FIG. 2 and FIG. 3, in another embodiment, the tool (100) incorporates a temperature sensor (200) to sense the surface temperature of the finish (15). In this embodiment, a status light (210), in conjunction with the finish material selector switch (165), is configured to turn on when the temperature of the finish (15) has reached its release temperature, signaling to the operator that it is clear to begin the scrapping stroke. The temperature sensor (200) is preferably mounted away from the heated work area using a port (205) within the tool body (110) for line-of-sight sensing of the work surface finish (15). Use of this embodiment is applicable to the beginning of a stroke where the operator is signaled to momentarily hold the tool (100) in position until the finish (15) is ready to be scraped. Then, as the operator begins the scraping stroke, the design and dimensioning of the hot air guide (130) is such that the finish (15) ahead of the advancing scraper blade (180) reaches its release temperature given the consistent stroke speed of the operator.

It is also contemplated that a variable or multi-speed electrical tan might be employed, controlled by either the finish material selector switch (165) or a separate switch element. Variable or multi-speed electrical tan embodiments are embodied similar to the electrical fan (160) from FIG. 1.

For finishes with excessive thicknesses, one generally performs a second or subsequent pass of the tool (100) to progressively remove the finish (15) down to the wood substrate. This approach ensures preservation of the underlying wood substrate.

In an alternate embodiment, the opposing open side (132) of the hot air guide (130) is not completely open, but rather is shorter than the front side (131) and opposing lateral sides (133). Design specifics of the open side might vary based upon desired air flow patterns, especially where desired finish (15) removal air flow rates differ when used in various applications. Furthermore, the hot air guide (130) may have an extension or an adjustable or replaceable angled bottom profile to accommodate different handle height positions during scraping. Thus, if the operator chooses to drag-scrape the finish (15) at a lower trailing angle (181) and, as a result, holds the handle (120) higher from the work surface, then the hot air guide front side (131) extends down further from the tool body (110), while the hot air guide lateral sides (133) would also co-extend down further at the adjacent hot air guide front side (131), resulting in maintenance of a reasonable gap between the hot air guide (130) and the work surface, which ensures adequate air (10) flow to disperse finish (15) flakes from the scraper blade (180).

Optimum forced convective heat transfer to the finish (15) is achieved when the heated air (10) is directed at, or close to, an angle normally incident on the finish (15). Alternate embodiments with heated air (10) incident onto the finish (15) at a nominal normal angle of incidence to the finish (15) are possible. However, for efficiency purposes, the use of vanes or other directive elements to direct the heated air (10) prior to impacting the work surface are not preferred.

In an alternate embodiment, the heat sink (170) is shielded from the air (10) exiting the hot air guide (130) to more effectively cool the scraper blade (180).

In some cases, the operator of the tool (100) may find that modifying the trailing angle (181) slightly may lead to improved results. The two-handled feature of the instant invention allows the operator to raise or lower the handle (120) as each stroke is made, thereby decreasing or increasing the angle of attack of the scraper blade (180) on the finish (15). Typically, best results with a drag scraper occur when the blade is positioned at a trailing angle (181) of approximately 15 degrees, but in any case, no more than 25 degrees.

Depending upon the scraper blade type (180) and edging, specific trailing angle (181) implementations will vary based upon applications. It should be clear that the instant invention can be configured to accommodate a variety of designs in this aspect, either through a fixed attachment, an adjustably-hinged attachment, use of shims or other known arrangement, in combination with handle positioning and hot air guide (130) dimensioning. It is preferred that the scraper blade (180) trailing angle (181) of incidence be adjusted by varying the angle of the heat sink (170) so that the optimized heat transfer from the scraper blade (180) to the heat sink (170) is not interrupted. If shims or similar arrangement is used to change the trailing angle (181) of the scraper blade (180) with respect to the heat sink (170), close attention should be paid to materials selection and interface to preserve optimized heat transfer from the scraper blade (180) to the heat sink (170).

Figure 5:
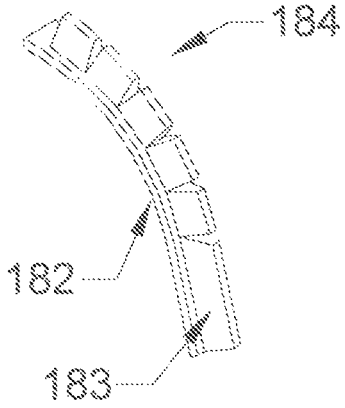
FIG. 5 illustrates an alternate embodiment of the electrically powered stripping tool scraper blade and heat sink.
Figure 6:
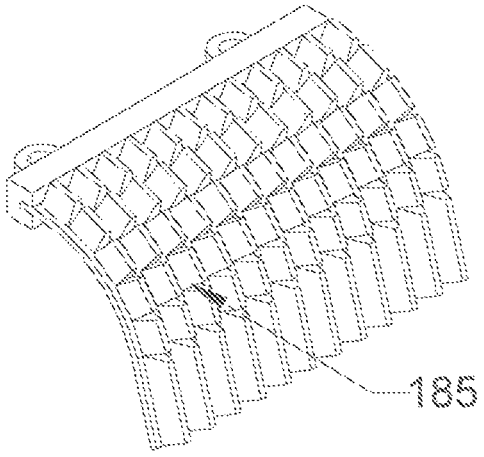
FIG. 6 illustrates an alternate embodiment of the electrically powered stripping tool scraper blade and heat sink.
Figure 7:
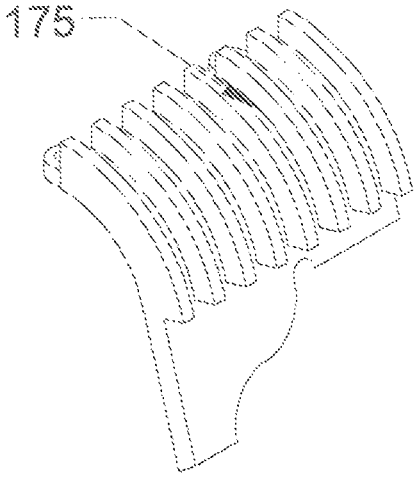
FIG. 7 illustrates an alternate embodiment of the electrically powered stripping tool scraper blade and heat sink.

FIG. 5. FIG. 6 and FIG. 7 exemplify alternate embodiments of the scraper blade and heat sink elements. FIG. 7 illustrates a profiled scraper blade (175) that comprises an integral heat sink. Use of a profiled blade is advantageous for contoured surfaces. A profiled scraper blade (175) may also be a separate blade that attaches to a separate heat sink, such as the heat sink (170) of FIG. 4. Given that a customized profiled scraper blade (175) would see relatively little lifetime usage, it may be made of a softer metal having a higher thermal conductivity, such as brass, which would facilitate easier heat transfer away from the blade. Furthermore, the shape of the hot air guide (130) may be modified to accommodate a profiled scraper blade (175) where the exiting air is directed to best clear the removed finish (15).

In an alternative embodiment shown in FIG. 6, scraper blade (185) comprises a plurality of flexible blades. In this arrangement, FIG. 5 exemplifies an individual flexible blade (184) comprising a scraper blade element (182) which allows for even pressure of the scraping edge against the work surface finish (15) when the work surface is textured, curved or has a discontinuous surface profile. In this embodiment, an attached heat sink element (183) is either separate or segmented so that it does not interfere with the ability of the blade (182) to flex as it follows the contour of the finish (15). This embodiment does not preclude extension of the inlet end (141) of the air flow duct (140) to accept a larger portion of the heat sink (183) into the internal cavity (143) of the air flow duct (140) in order to convect heat away from the heat sink (183).

In an alternate embodiment, exhaust ducting to capture the released finish (15) flakes can be added to at least one side of the tool (100) adjacent to the scraper blade (180) so that the released finish (15) flakes can be directed into a container or a vacuum system or other method of capture.

In alternate embodiments, the tool (100) comprises heat shields below the handle (120) or second handle (190) or around the air flow duct (140) to direct any excess heat away from the operator's hands. Typical heat shield arrangements might be a non-structural planar or shaped skin wrapped around or in front of a heated element between the heated element and the operator's hand positions with a gap between the heated element and the heat shield.

It will readily be apparent to those skilled in the art that other applications are possible for the present invention, and while the embodiments described herein are illustrative of the invention, other modes of implementation are both within the spirit and scope of the invention.

What is claimed is:

1. An electrically powered stripping tool for removing finish from a work surface, comprising:

a tool body comprising a tool end, an opposing handle end comprising a handle, and a work surface side extending between the tool end and the opposing handle end, an air flow duct comprising an inlet end, an outlet end, and an internal cavity extending between the inlet end and the outlet end, the inlet end located at the tool end of the tool body facing the work surface side of the tool body, the outlet end extending out from the work surface side of the tool body, an electrical heating element located within the air flow duct internal cavity between the inlet end and the outlet end, an electrical fan located within the air flow duct internal cavity between the inlet end and the electrical heating element, the electrical fan configured to draw air into the inlet end of the air flow duct and direct it through the air flow duct internal cavity past the electrical heating element and out of the outlet end of the air flow duct, a heat sink comprising a rigid thermally conductive material attached to the tool end of the tool body such that a portion of the heat sink extends substantially into the internal cavity of the air flow duct at the inlet end of the air flow duct, and another portion extends out from the work surface side of the tool body, a scraper blade attached to and in thermal communication with the heat sink such that the scraper blade extends out from the heat sink to the work surface side of the tool body adjacent to the air flow duct outlet end, and a second handle located near the tool end of the tool body.

2. The electrically powered stripping tool of claim 1 comprising a hot air guide, the hot air guide comprising:

a front side, an opposing open side, and two opposing lateral sides, wherein the opposing front and open sides adjoin the two opposing lateral sides in a substantially rectangular shape, and wherein the hot air guide is positioned on the work surface side of the tool body such that the opposing open side is adjacent to the scraper blade, and wherein the outlet end of the air flow duct terminates into the hot air guide.

3. The electrically powered stripping tool of claim 2 wherein the hot air guide comprises an extension or replaceable angled bottom profile to accommodate different handle height positions during scraping.

4. The electrically powered stripping tool of claim 1 wherein the electrical fan is configured to operate at a power selectable speed.

5. The electrically powered stripping tool of claim 1 wherein the electrical heating element is configured to operate at a power selectable heat.

6. The electrically powered stripping tool of claim 1 further comprising a finish material selector switch located on the tool body, the switch configured to control the power supplied to the heating element.

7. The electrically powered stripping tool of claim 6 wherein the finish material selector switch is configured to control the power supplied to the electrical fan.

8. The electrically powered stripping tool of claim 1 wherein the heat sink comprises an aluminum alloy.

9. The electrically powered stripping tool of claim 1 wherein the heat sink comprises a copper alloy.

10. The electrically powered stripping tool of claim 1 wherein the scraper blade extends out from the heat sink at a trailing angle of incidence.

11. The electrically powered stripping tool of claim 10 wherein the heat sink is attached to the tool body via an adjustable hinge, variable thickness shims or other known positioning arrangement so that the scraper blade trailing angle of incidence is adjustable.

12. The electrically powered stripping tool of claim 10 wherein the trailing angle of incidence is between 10 degrees and 25 degrees.

13. The electrically powered stripping tool of claim 1 wherein the scraper blade comprises a thermally conductive factor of greater than 40 W/m-K.

14. The electrically powered stripping tool of claim 1 wherein the air duct comprises an air duct heat shield to contain heat and protect a user from burns.

15. The electrically powered stripping tool of claim 1 comprising a handle heat shield under the second handle to protect a user from burns.

16. The electrically powered stripping tool of claim 1 comprising a temperature sensor, for sensing the temperature of the finish ahead of the scraper blade, and a status light configured to signal when the finish ahead of the blade has attained a pre-set temperature.

* * * * *